United States Patent [19]

McKee et al.

[11] Patent Number: 4,804,188

[45] Date of Patent: Feb. 14, 1989

[54] GOLD CLUB HEAD

[76] Inventors: John B. McKee, P.O. Box 98, Friar's Point, Miss. 38631; L. C. White, 256 Bermuda Dr., Greenville, Miss. 38701

[21] Appl. No.: 58,819

[22] Filed: Jun. 5, 1987

[51] Int. Cl.[4] ..... A63B 53/04

[52] U.S. Cl. ..... 273/167 R; 273/173; 273/77 A; 273/78; 273/171

[58] Field of Search ..... 273/173, 77 A, 167 R, 273/167 H, 167 J, 78, 171, 174, 167 F

[56] References Cited

U.S. PATENT DOCUMENTS

| | | | |
|---|---|---|---|
| 974,888 | 11/1910 | Jarobus | 273/173 |
| 1,463,533 | 7/1923 | Kurz | 273/173 |
| 3,233,905 | 2/1966 | Flom | 273/173 |

OTHER PUBLICATIONS

"Know Your Woods", Albert Constantine, Jr. Charles Scribner's Sons, New York, 1959.

"Imported Wood Purchasing Guide", 13th Edition, 1985.

*Primary Examiner*—George J. Marlo

*Attorney, Agent, or Firm*—Rogers, Howell, Moore & Haferkamp

[57] ABSTRACT

A golf club comprises the wood Balfourodendron Riedelianum, which wood is also known as Guatambu or Pau Marfim. The wooden part of the club can be shaped as the wooden part of persimmon clubs known in the prior art. The club head can have a notch in its front face for receiving an inlay plate for striking the ball, as known in the art. The club head can have a bore located behind the inlay with an insert housed within the bore. The insert, as well as the plate, can be made of graphite or of plastic such as "CYCOLAC" Trademark plastic. The insert and plate members can be unitary. Tests show that Balfourodendron Riedelianum has a higher coefficient of restitution than persimmon. A golf club made of Balfourodendron Riedelianum will drive a golf ball farther than an identical golf club made of persimmon.

13 Claims, 2 Drawing Sheets

FIG. 1.
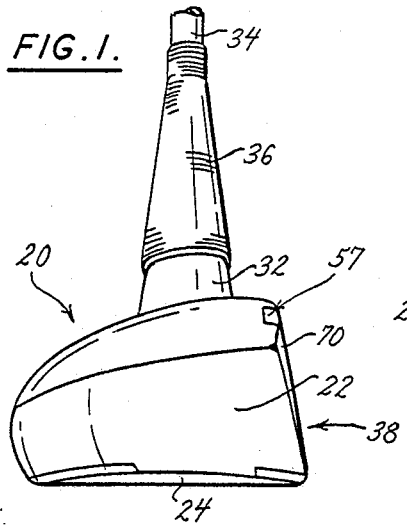
FIG. 2.
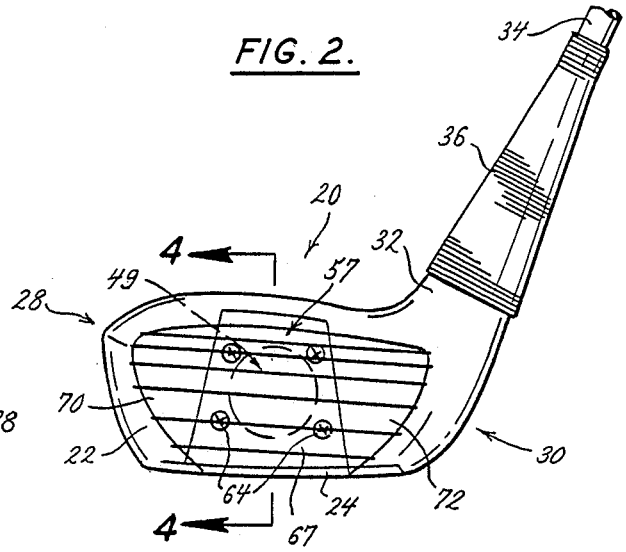
FIG. 4.
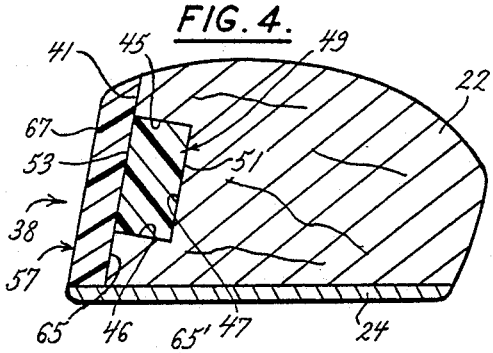
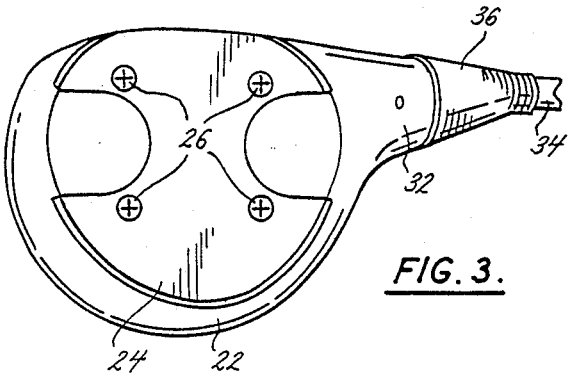
FIG. 3.
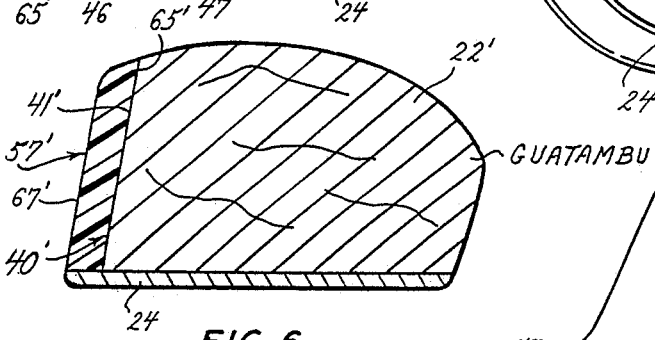
FIG. 6.
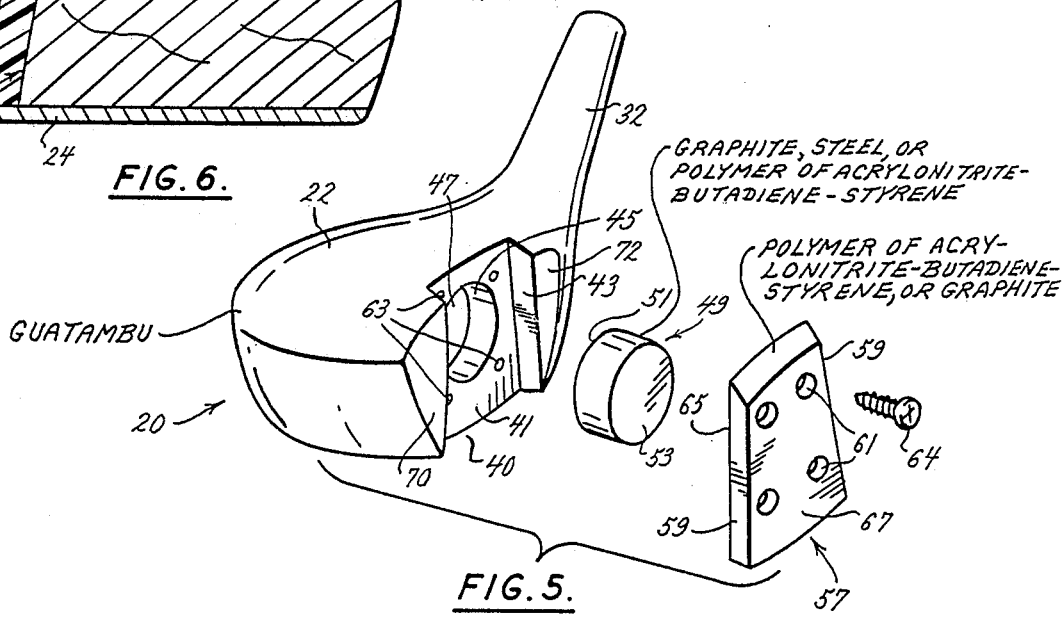
FIG. 5.

GOLD CLUB HEAD

RELATED DISCLOSURE DOCUMENT

This application relates to a Disclosure Document filed by the inventors, John McKee and L. C. White in the U.S. Patent & Trademark Office on Oct. 24, 1986 and having Patent & Trademark Office Disclosure Document No. 158029. The Disclosure Document No. 158029 is herein incorporated by reference and made a part of this application.

FIELD OF THE INVENTION

This invention relates to golf clubs, and in particular to wooden golf clubs commonly known as "woods". In the prior art such clubs have comprised persimmon wood. Typically these clubs have had a face plate inlay which fits into a notch in the front striking face of the club. The face plate is centrally positioned to strike the ball with a normal golf swing. The face plate can be of plastic such as sold under the Trademark "CYCOLAC" by Borg-Warner Corporation. Screws or glue secure the face plate within the notch of the club head.

The "wood" clubs have had different shapes and sizes so that a golfer can select a club of a particular shape and size for an individual golf shot, depending upon the distance the ball is located from the hole, and the lie of the ball on the terrain of the course. The clubs range from the largest club, known as a driver which has a face angled more toward the vertical when the club head is placed with its sole plate, or bottom, on the ground, to clubs consecutively numbered as 2, 3, 4, 5, 6, 7, and 8 which are respectively each smaller than the numbered club directly beneath it, and which each have a club face angled more toward the horizontal than the numbered club directly beneath it. The distance that a golf ball is hit by a "wood" club is a crucial part of a golf game. The distance affects whether the ball will land on the green or not or whether the ball clears a hazard on the course. The distance affects the distance of the ball from the pin on the next shot.

It is desirable to have a "wood" club that will hit a golf ball farther than a club comprising persimmon.

It is desirable to have such a club which will have an attractive wooden finish.

Additionally it is desirable to construct a club with an insert located behind the face plate of the club to take advantage of the properties of the insert.

Persimmon clubs have larger springwood vessels than summerwood vessels. If a sealer is not applied before staining the persimmon, then the large springwood vessels absorb more stain than the summerwood vessels, and gives the surface an unattractive splotchy appearance. To avoid this lack of aesthetics, a sealer is used before staining in the prior art.

SUMMARY OF THE INVENTION

The present invention improves over the prior art. The invention features a golf club "wood" which is comprised of the wood named Balfourodendron Riedelianum. This wood is also known as Guatambu or Pau Marfim. The wood is generally known in Brazil where it is grown as Pau Marfim, and in Argentina and Paraguay where it is also grown, as Guatambu. Hereafter this wood is referred to as Guatambu.

The Guatambu wood can be formed into a golf club "wood" to form clubs having the shape of the clubs known in the art as Number 1, 2, 3, 4, 5, 6, 7 and 8 woods or other shape. A face plate made of plastic, such as "CYCOLAC" Trademark plastic, or of graphite can be inserted in a notch in the face of the Guatambu golf club "woods".

Moreover, the invention comprises the Guatambu golf wood having a bore behind the face plate inlay for receiving an insert such as of cylindrical shape. The insert can be of graphite or of plastic such as "CYCOLAC" Trademark plastic.

Tests have been conducted by shooting golf balls with an air gun to strike wooden blocks of Guatambu and of persimmon. The superiority of Guatambu as shown by the test results has been surprising.

Coefficients of restitution were calculated for Guatambu and persimmon from the test results. The wood samples were stationary and were mounted in a test fixture of extremely large relative mass. The golf balls were propelled toward the wood samples in a straight line perpendicular to the plane of contact. The coefficient of restitution is the ratio of golf ball velocity of separation after impact to the velocity of the golf ball approach.

The test results comparing the persimmon wood to the Guatambu at about 12% moisture showed the coefficient of restitution for Guatambu to be from 8.5% to 10% more than that of persimmon.

When "CYCOLAC" Trademark plastic inlay plates were attached to the fronts of both the Guatambu and persimmon blocks and balls shot against the "CYCOLAC" Trademark plates, the Guatambu-plastic block was found to have a coefficient of restitution 11.3% higher than the persimmon-plastic block. When graphite plates were attached to the wood blocks, and balls shot thereagainst, the Guatambu-graphite block had a coefficient of restitution 2% higher than the persimmon-graphite block.

The test results show that "wood" golf clubs comprising Guatambu having identical shape of a club made of persimmon, will transmit a larger proportion of the club head kinetic energy to the golf ball resulting in a drive that is 8.5% to 10.6% longer than that produced by persimmon golf club heads of identical manufacture.

Additional length with golf shots can be crucial in placing the ball on the green near the pin, closer to the green, beyond a course hazard, or otherwise in a more desirable lie. Hence, the invention can product a marked improvement in one's golf score and satisfaction from playing golf.

Guatambu clubs also absorb stain much more evenly and aesthetically then persimmon clubs. As noted, persimmon requires a sealer before staining in order to avoid a splotchy appearance. Guatambu is a closed-vessel ringporous wood, and hence a sealer does not have to be applied before staining. This saves costs and materials, and eliminates a step in the manufacturing process.

DESCRIPTION OF THE DRAWINGS

FIG. 1 is an end view of a number 1 golf club made of Guatambu;

FIG. 2 is a front plan view of a number 1 golf club made of Guatambu;

FIG. 3 is a bottom plan view of a number 1 golf club made of Guatambu;

FIG. 4 is a section taken on the line 4—4 of the number 1 Guatambu golf club of FIG. 2;

FIG. 5 is an exploded view of a number 1 Guatambu golf club having a cylindrical insert and a face plate inlay;

FIG. 6 is a section of a Guatambu golf club of standard configuration without an insert;

DESCRIPTION OF THE PREFERRED EMBODIMENT

Figure 7:
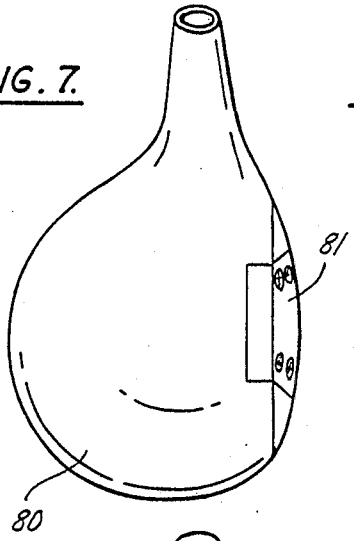
FIGS. 7, 9, 11 and 13 are top plan views of Number 2, 3, 4 and 5 woods, respectively, comprised of Guatambu.

The drawings show golf clubs made of Guatambu. The clubs pictured are of the type commonly referred to as "woods". The club shown in FIGS. 1–5 is a "Driver" or a Number 1 "Wood". The driver 20 comprises a club head 22. Head 22 has a sole plate 24 made of metal attached within a conforming recess to the bottom of the head by screws 26, as is known in the art.

The club head 22 has what are commonly known as a toe end 28 and a heel end 30. Extending upwardly from the heel 30 is a mount extension or hosel 32 which tapers from its larger lower end upwardly to be of narrower width. The hosel 32 has, as known in the art, a bore (not shown) which receives the lower end of a metal shaft 34. The shaft 34 is further secured to the hosel 28 by a tightly wound cord 36 which extends along the length of the hosel 32 and along part of the shaft 34, and additionally held by adhesive, as known in the art.

The face 38 of the club head 22 has a notch 40 therein. Notch 40 has a front wall 41 and two side walls 43. A cylindrical bore 45 extends through the notch front wall 41 into the club head 22. The bore 45 has a rear wall 47

A cylindrical insert 49 is sized to be snugly telescopically received within bore 47. The rear surface 51 of insert 49 fits flush against the rear bore wall 47. The front surface 53 of insert 49 fits flush with the notch wall 41. The insert 49 can comprise graphite, steel, or plastic such as "CYCOLAC" Trademark plastic. "CYCOLAC" is a Trademark of Borg- Warner Corporation of Chicago, Ill. "CYCOLAC" Trademark plastics comprise polymers of acrylonitrite-butadiene-styrene. The graphite can be parallel sheets of graphite held together by an adhesive. The sheets are oriented to be parallel with plate 57.

A face plate inlay 57 comprised of plastic such as "CYCOLAC" Trademark plastic, or of graphite, is shaped to be snugly and telescopically received within notch 40. Other suitable plastic plates 57 could be used. The side walls 59 of face plate 57 fit snugly against side walls 43 of notch 40 as is known in the art. Face plate 57 has holes 61 which can be aligned with holes 63 extending into notch wall 41 so that screws 63 can extend therethrough to mount plate 57 to the club head 22. As seen in FIG. 4, the rear wall 65 of plate 57 fits flush against the front surface 53 of insert 49, as well as flush against front wall 41 of notch 40.

Ideally the size of bore 47, insert 49, notch 40 and plate 57 are machined with such tolerances to give snug abutment contact of insert 49 against bore walls 46 and 47 and the rear wall 65 of plate 57, so that force is transferred effectively between all the said members. However, because such tolerances can be difficult to achieve, epoxy glue or other suitable adhesive can be used along the surfaces or walls 41, 43 and 51 to hold those walls to the adjoining surfaces of plate 57. Likewise, the insert 49 can be held within bore 45 as by epoxy glue or other adhesive with such glue being applied as a thin layer between insert surface 51 and bore rear wall 47, and between the bore side walls 46 and the insert 49.

Plate 57 has a front surface 67 for striking a golf ball. The club face 38 has front wooden surfaces 70 and 72 located to the sides of face plate surface 67, as is known in the art. Plate surface 67 extends smoothly into the contour of surfaces 70 and 72. The material forming the insert 49 and plate 57 can be integral so that members 49 and 57 are a unitary piece. This will provide for a more solid transfer of energy between the material comprising members 49 and 57. The material for such unitary member can be "CYCOLAC" Trademark plastic or graphite.

The club head 22 can also have a bore extending upwardly from the sole for mounting a metal weight as known in the art, such not being shown for purposes of clarity. The insert 49 can be approximately 1 $\frac{1}{4}$ inch (3.18 cm) in length and approximately $\frac{3}{4}$ inch (1.91 cm) in diameter, and can range to approximately $\frac{7}{8}$ inch (2.22 cm) diameter to about $\frac{3}{8}$ inch (0.95 cm) in length as is shown in the drawings. The insert 53 is preferably centered in the club head. The insert can have shapes other than cylindrical, such as rectangular or trapizoidal.

The Guatambu golf club also can have a club head 22′ of standard configuration known in the art, as shown for the Driver or Number 1 wood of FIG. 6. In this embodiment, the club head 22′ does not have an insert such as 49 as illustrated in FIGS. 1–5 drawings. The club head 22′ has a notch 40′ which has a flat rear wall 41′. Wall 41′ is like wall 41 but without a bore 45. Notch 40′ has side walls (not shown) identical to side walls 43. Notch 40′ also receives a face plate 57′ mounted in the same way as shown in FIGS. 1–5, with the adhesive extending upon wall 41′ and the rear wall 65′ of plate 57′.

Guatambu is a straight-grained wood with interlocking fibers. The grain of the wood is preferably oriented to be more toward the perpendicular of the notch wall 41 or 41′. Ideally, the wood grain is substantially perpendicular to wall 41 or 41′. However, because of the curvature of the grain, and the inexact process of cutting clubheads, it will be difficult to obtain the ideal orientation in the manufacture of each club.

Figure 9:
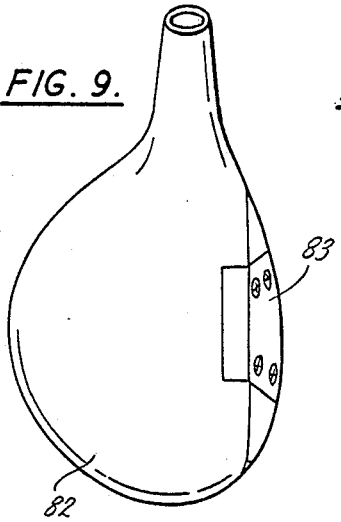
Figure 11:
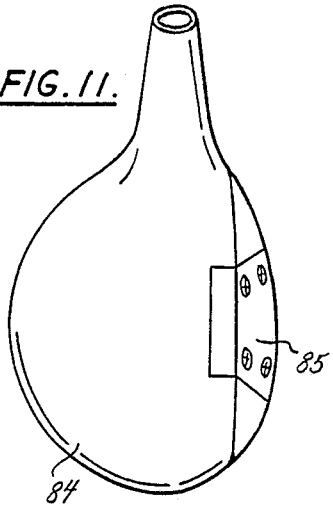
Figure 8:
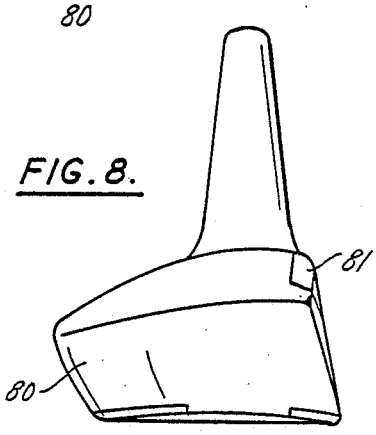
FIGS. 8, 10, 12 and 14 are front plan views of each of the golf clubs shown in FIG. 7, 9, 11 and 13, respectively.
Figure 10:
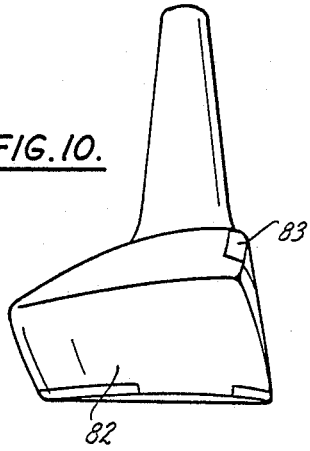
Figure 12:
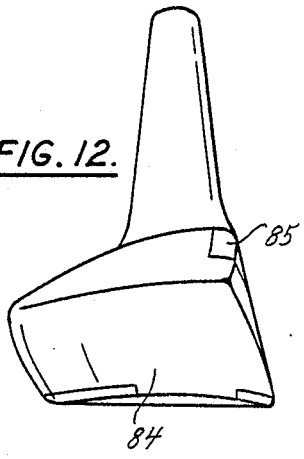
Figure 13:
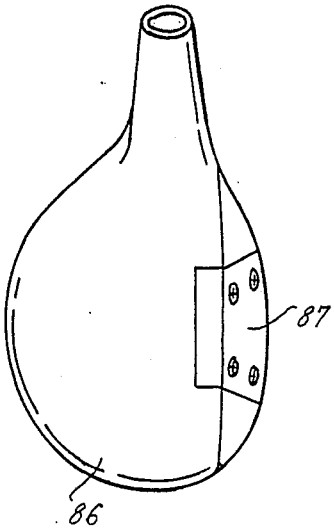
Figure 14:
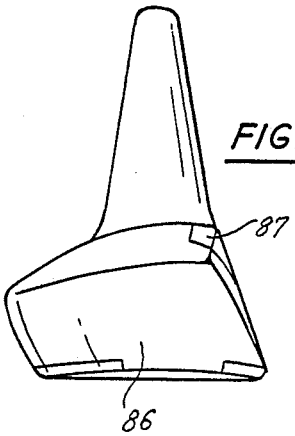

The Guatambu golf club can also have the shape of a 2, 3, 4, or 5 wood as shown in FIGS. 7–14. Each of such clubs can be made with an insert such as 49 as shown for the driver in FIGS. 1–5. Each of the clubs of FIGS. 7–14 can also be made without the insert such as 49 in the same way illustrated in FIG. 6. FIGS. 7–8 show a club head 80 of a two wood, with a face plate 81 mounted in the front face thereof. FIGS. 9–10 show a three wood club head 82 with a face plate 83 mounted in the front face thereof. FIGS. 11–12 show a number 4 club with a face plate 85 mounted to the front thereof, while FIGS. 13–14 likewise show a number 5 club head 86 with a face plate 87 mounted in the front thereof. Likewise, one with ordinary skill in the art is aware of the structure of a number 6 wood, number 7 wood, or number 8 wood and could construct them with the same wooden portion made of Guatambu as known in the art for persimmon with a face plate mounted therein as known in the art. An insert such as 49 could also be mounted in said clubs. The insert such as 49 used for clubs Number 2 through 9 would be smaller than used for the Driver of FIGS. 1–5, because of the smaller clubhead size. The size of the insert 49 for such clubs would be smaller sequentially for each club, i.e., the size insert for a Number 3 wood is smaller than for a Number 2 wood but larger than for a Number 4 wood.

Tests conducted with Guatambu and with persimmon have shown Guatambu to be a much superior wood for use in golf club "woods". Tests were conducted by propelling gold balls moving at a known velocity to impact stationary pieces of sample Guatambu wood and persimmon mounted to test fixtures of extremely large relative mass. The golf balls were propelled in a straight line perpendicular to the plane of contact.

The coefficients of restitution between the two woods were compared. The coefficient of restitution is the ratio of the golf ball velocity of separation after impact to the velocity of the ball approach. The velocity of the wooden blocks was essentially zero. Therefore the coefficient of restitution involving the collision would be dependent upon and determined by the ball velocity after impact divided by the velocity of the ball on approach.

A strobe light was used to measure the velocity of the balls on approach and upon separation from the wood. Multiple exposure of the ball upon approach and upon separation were made with a camera.

Tests were conducted to measure the coefficient of restitution on raw samples of Guatambu and persimmon. The face of the Guatambu block and of the persimmon block upon which the golf balls impacted had the grain of the wood extending approximately perpendicular thereto. Guatambu is a straight-grained wood with interlocking fibers. The initial velocity of the golf ball on approach was in the range of 90 to 110 feet per second.

Balls were shot against blocks of Guatambu and persimmon to strike the wooden surface thereof. Tests results show that the coefficient of restitution for Guatambu compared to persimmon was from 8.5% to 10.6% higher for Guatambu than for persimmon with a moisture content of about twelve percent. Later tests conducted on the raw wood without any plates mounted thereto showed the coefficient of restitution for the Guatambu to be seven percent higher than the coefficient of restitution of persimmon at a moisture content of about eight percent.

Tests were also conducted by mounting a "CYCOLAC" Trademark plate to the face of the raw wood. The moisture content of the woods at this time was approximately 8%. Golf balls were shot against the "CYCOLAC" Trademark plate as mounted to the woods with the plates mounted approximately perpendicular to the grain of the woods. The results showed that the coefficient of restitution using Guatambu-"CYCOLAC" Trademark plastic was 11.3% higher than the coefficient of restitution with persimmon-"CYCOLAC" Trademark plastic. Tests were also conducted with graphite plates mounted to Guatambu and to persimmon so that the plates were likewise approximately perpendicular to the grain of the wood. The coefficient of restitution for such tests were 2% higher for the Guatambu-graphite plate block than persimmon-graphite block. It was noted that the graphite inlay was a more rigid material than the "CYCOLAC" Trademark plastic, and that the graphite inlay would therefore distribute an impact force over the face area of the inlay whereas the "CYCOLAC" Trademark plate impact force would be concentrated around the area of the ball impact.

Tests were also run with actual golf clubs. The testing personnel found the test results were inconclusive because the club heads were not of identical shape for the Guatambu and persimmon and because such slight differences in dimensional characteristics of golf clubs, variation in where the golf ball impacts the face of the club, whether the ball impacts against a screw or part thereof, how secure the club was held in the test fixture used to hold the club, could all cause variants in the results.

The test personnel concluded that Guatambu would be a superior material to persimmon to be used in the manufacture of a wooden golf club head since it will transmit a larger proportion of the club head kinetic energy to the ball resulting in a drive that is 8.5% to 10.6% longer than that produced by persimmon golf club heads of identical manufacture.

Those using a golf club comprising Guatambu in playing the game of golf have been extremely satisfied with the distances achieved by striking the golf ball with the Guatambu club.

Guatambu is a closed-vessel ring-porous wood and hence a sealer does not have to be applied before staining the wood. In contrast, persimmon is a diffused porous wood with large vessels in the springwood thereof which require a sealer application before staining. The large springwood vessels in persimmon absorb more stain than the summerwood vessels and cause dark spots on the wood if a sealer is not applied before staining. Hence with a Guatambu club the sealing process before staining could be eliminated in the production process.

What we claim is:

1. A golf club head of the type known as a "wood", for playing the game of golf, comprising: the club head having a toe and a heel end, a hosel, an area for receiving a sole, and a backwardly slanted front face having an area for receiving a striking surface, the club head comprising Balfourodendron Riedelianum wood, also known as Guatambu wood and as Pau Marfim wood.

2. The golf club head "wood" of claim 1 wherein the club head front face has a notch therein, and a plate inlay with means for mounting the inlay plate securely within the notch of the club head, the inlay plate having a surface for striking a golf ball.

3. The golf club head "wood" of claim 2, further comprising: the club head having a bore extending from the notch into the club head; and an insert located within the bore.

4. The golf club head "wood" of claim 3 wherein the plate is made of plastic comprising polymers of acrylonitrite-butadiene-styrene.

5. The golf club head of claim 1 wherein the Balfourodendron Riedelianum wood has a moisture content in the range of 8% to 12%.

6. The golf club head of claim 1 wherein the Balfourodendron Riedelianum wood has a moisture content of 12%.

7. The golf club head of claim 3 wherein the insert has a front surface, the notch has a front wall, and the front surface of the insert is approximately flush with the front wall of the notch.

8. The golf club head of claim 7 wherein the inlay plate has a rear wall which fits approximately flush against the front surface of the insert and against the front wall of the notch.

9. The golf club head of claim 3 wherein the insert comprises graphite.

10. The golf club head "wood" of claim 3 wherein the insert comprises a plastic comprising polymers of acrylonitrite-butadiene-styrene.

11. The golf club of claim 3 wherein the insert and inlay plate are unitary.

12. A golf club head of the type known as a "wood," for playing the game of golf, the club head having a toe end and a heel end, and a backwardly slanted front face including a ball striking surface, the club head having a bore extending therein behind the striking surface and comprising Balfourodendron Riedelianum wood, such wood also being known as Guatambu wood and as Pau Marfim wood.

13. The golf club head wood of claim 12 wherein the Balfourodendron Riedelianum wood has a moisture content in the range of 8% to 12%.

* * * * *

UNITED STATES PATENT AND TRADEMARK OFFICE

CERTIFICATE OF CORRECTION

PATENT NO. : 4,804,188

DATED : February 14, 1989

INVENTOR(S) : John B. McKee; L. C. White

It is certified that error appears in the above-identified patent and that said Letters Patent is hereby corrected as shown below:

Title on page 1 and at top of column 1:

"GOLD CLUB HEAD" should be changed to read:

-- GOLF CLUB HEAD --

Signed and Sealed this

Twenty-fifth Day of July, 1989

*Attest:*

*Attesting Officer*

DONALD J. QUIGG

*Commissioner of Patents and Trademarks*